United States Patent [19]

Glenn

[11] 4,093,399

[45] June 6, 1978

[54] TURBINE ROTOR WITH CERAMIC BLADES

[75] Inventor: Robert G. Glenn, Huntington Valley, Pa.

[73] Assignee: Electric Power Research Institute, Inc., Palo Alto, Calif.

[21] Appl. No.: 746,443

[22] Filed: Dec. 1, 1976

[51] Int. Cl.[2] ..... F01D 5/08; F01D 5/30

[52] U.S. Cl. ..... 416/95; 416/219 R; 416/241 B; 416/248; 416/193 A

[58] Field of Search ..... 416/95, 219, 241 B, 416/96, 248, 193 A

[56] References Cited

U.S. PATENT DOCUMENTS

| | | | |
|---|---|---|---|
| 2,364,189 | 12/1944 | Büchi | 416/193 A |
| 2,686,655 | 8/1954 | Schorner | 416/241 B X |
| 2,836,392 | 5/1958 | Spaeth | 416/193 A X |
| 2,873,947 | 2/1959 | Perry | 416/241 B X |
| 3,002,675 | 10/1961 | Howell et al. | 416/193 A |
| 3,702,222 | 11/1972 | Bernales | 416/193 A |
| 4,019,832 | 4/1977 | Salemme et al. | 416/248 X |
| 4,032,258 | 6/1977 | Snell | 416/219 R X |

FOREIGN PATENT DOCUMENTS

| | | | |
|---|---|---|---|
| 740,757 | 11/1955 | United Kingdom | 416/248 |

*Primary Examiner*—Everette A. Powell, Jr.
*Attorney, Agent, or Firm*—Townsend and Townsend

[57] ABSTRACT

A turbine rotor having a number of metallic attachment pieces for coupling a plurality of ceramic blades to a metallic rotor disk. The blades have roots which are received within grooves formed in the attachment pieces. Each attachment piece has passage means therethrough cooperating with passages in the rotor disk for receiving a coolant for cooling the attachment pieces without causing the coolant to contact the ceramic blades. The attachment pieces keep the rotor disk isolated from the hot gases which contact the ceramic blades.

8 Claims, 1 Drawing Figure

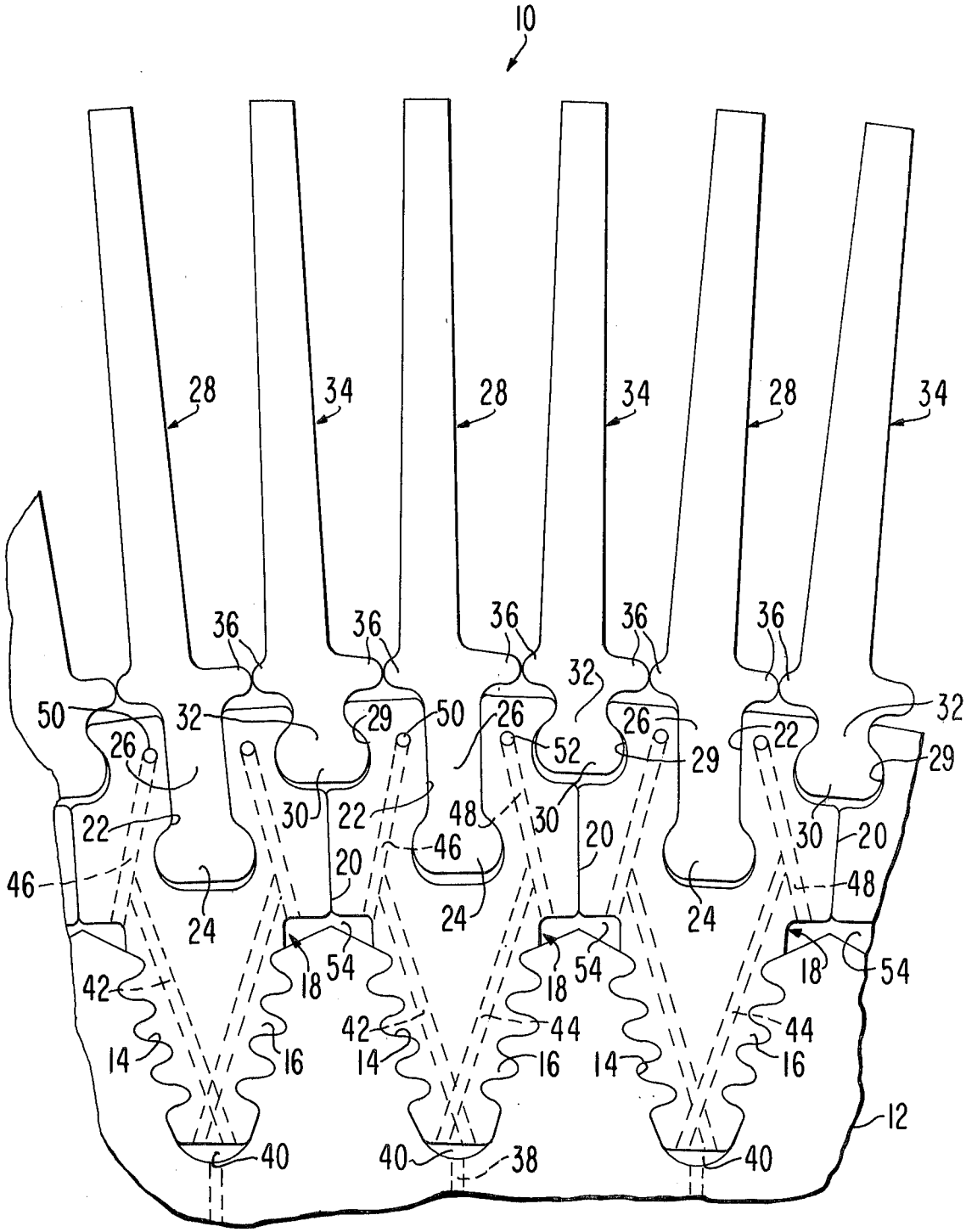
10
28
34
28
34
28
34
36
36
36
36
36
32
50
32
29
50
26
26
52
29
22
32
29
26
22
30
22
48
30
20
30
20
46
20
46
48
24
24
24
18
54
18
54
18
54
42
42
44
44
14
16
14
16
14
16
12
40
40
38
40

TURBINE ROTOR WITH CERAMIC BLADES

This invention was made under contract with or supported by the Electric Power Research Institute, Inc.

This invention relates to gas turbine engines and, more particularly, to improvements in the rotor of such an engine.

BACKGROUND OF THE INVENTION

The efficiency of a gas turbine may be improved by raising the turbine gas inlet temperature. In the present state of the art, this temperature is limited because both the blades and rotor disk of the turbine rotor are metallic and cannot withstand gas temperatures above certain maximum values. If these parts are cooled beyond a certain point, there is a loss in performance which offsets the gain from an increase of gas temperature.

Ceramic blades are now under investigation for replacement of the metallic blades of a turbine rotor. Ceramic blades do not conduct heat because of their amorphous structure, yet they pose several problems, including the problem of attaching them to the rotor disk in such a way that hot turbine gases for driving the blades are maintained out of heat exchange relationship to the rotor disk whose metallic structure cannot be heated beyond a certain maximum temperature. A need has, therefore, arisen to provide an improved mount for ceramic blades of a turbine rotor to achieve the foregoing aim.

SUMMARY OF THE INVENTION

The present invention is directed to an improved turbine rotor having a rotor disk, a plurality of circumferentially spaced ceramic rotor blades having roots, and a number of attachment pieces of high temperature metal for coupling the roots of the blades to the outer periphery of the rotor disk. The blades have roots which are received within grooves formed in the attachment pieces, and the attachment pieces are of a size and at locations on the rotor disk such that the blades are spaced from the rotor disk, and the rotor disk itself is effectively isolated from the hot gases which impinge on the ceramic blades to exert rotative forces thereon.

The attachment pieces are provided with fluid passages therethrough which communicate with passages in or on the rotor disk to permit a coolant to flow in heat exchange relationship to the attachment pieces, yet the coolant is kept out of contact with the roots of the ceramic blades. Thus, the attachment pieces are cooled without creating high thermal gradients along the blades themselves. Also, the cooling contributes to the protection of the rotor disk from exposure to the high temperature of the gases impinging on the blades.

The roots of adjacent blades are of different lengths. This feature permits the roots to be relatively thick and allows the attachment pieces to be large enough to provide sufficient strength yet accommodate a relatively large number of blades.

The primary object of this invention is, therefore, to provide an improved turbine rotor which has fluid-cooled attachment means for mounting a plurality of ceramic turbine blades on a central rotor disk and for isolating the rotor disk from high temperature gases used to drive the blades to thereby permit an increase in the gas inlet temperature of the turbine to improve its efficiency without causing damage to the rotor disk and without creating high thermal gradients along the blades.

Another object of this invention is to provide a turbine rotor of the type described wherein the attachment pieces have grooves formed therein to receive the roots of the blades and the attachment pieces further have passages extending therethrough to permit a coolant to flow in heat exchange relationship therewith, whereby the blades are properly mounted on the rotor disk without structural damage to the blades due to the high temperature gradients or structural damage to the rotor disk due to the high heat content of the incoming gases.

Still a further object of the present invention is to provide a turbine rotor of the aforesaid character wherein the roots of adjacent blades are of different lengths to permit the use of relatively thick roots without limiting the size of the attachment pieces and thereby keeping the strength of the roots and the attachment pieces relatively high.

Other objects of this invention will become apparent as the following specification progresses, reference being had to the accompanying drawing which shows a single FIGURE representing a vertical section through a turbine rotor formed in accordance with the teachings of the present invention.

The turbine rotor 10 has a rotor disk 12 provided with a plurality of outer peripheral grooves 14 for receiving the roots 16 of respective attachment pieces 18, only three of which are shown in the FIGURE to simplify the drawing. Roots 16 are of the standard fir tree type and they slide into grooves 14 and are substantially complemental thereto. Thus, disk 12 has a length which extends perpendicular to the FIGURE throughout a predetermined distance. For purposes of illustration, the disk has a diameter of about six feet and a length of about six inches.

Rotor disk 12 is of a particular type of metal and must be protected by attachment pieces 18 from exposure to high-temperature gases which drive rotor 10 and are supplied by an external source (not shown). To this end, the sides of adjacent attachment pieces are flat and substantially abut each other to form surface-to-surface contact at junctions 20, each of which can be provided with a sealant to prevent gases from penetrating between the attachment pieces and directly contacting the rotor disk.

Each attachment piece projects outwardly from the rotor disk as shown in the FIGURE. Moreover, each attachment piece has a groove 22 of the shape of an inverted keyhole. This groove is to receive the root 24 and root shank 26 of a respective ceramic rotor blade 28. The axial length of each groove 22 is equal to at least a major portion of the axial length of the rotor disk; similarly, the axial lengths of root 24 and shank 26 of each blade 28 are also substantially equal to the axial length of the corresponding groove 22. Root 24 and shank 26 are complemental to groove 22 and enter the same at one end of the corresponding attachment piece.

Each pair of adjacent attachment pieces 18 forms another groove 29 for receiving the root 30 and shank 32 of a second type of ceramic blade 34, the only substantial difference between blades 28 and 34 being the lengths of their respective shanks 26 and 32, the length of each shank 26 being greater than that of each shank 32. The reason for this difference of length is to permit the roots and shanks of the blades to be relatively thick and also to avoid having to limit the size and shape of the attachment pieces to accommodate a relatively large number of blades.

Root 30 and shank 32 of each blade 34 are slidably and complementally received within the corresponding groove 29. Also, blades 28 and 34 are of substantially the same axial length and are of substantially the same radial length. Adjacent blades have abutting projections 36 so that the blades have substantially no circumferential movement relative to adjacent attachment pieces when their roots and shanks are in respective grooves. With the mounting arrangement as described above, hot gases impinging on the blades do not penetrate the attachment pieces and contact the rotor disk. Moreover, the relatively thick roots and shanks on the blades is to reduce the stresses in these members.

Each attachment piece 18 is provided with fluid passages therethrough for permitting flow of a coolant in heat exchange relationship therewith. For purposes of illustration, a suitable coolant flows from a source externally of rotor disk 12 to and through the hub of the rotor disk and through a passage 38 to a reservoir 40 at the apex end of each attachment piece 18, respectively. From there, the coolant flows through two inclined passages 42 and 44 which communicate with respective second passages 46 and 48. Passages 46 and 48 then communicate with axially extending passages 50 and 52, respectively, which extend along substantially the entire length of the corresponding attachment piece 18, finally communicating with additional passages of the same character as passages 42, 44, 46 and 48. Then, the coolant returns to the hub by way of another passage, similar to passage 38. Suitable pump means externally of the rotor disk will be provided to assure a steady flow of coolant through the various passages. As the coolant flows through the passages, the attachment pieces are cooled and the rotor disk is further protected from the high heat energy content of the gases impinging on the rotor blades. In the alternative, passages 46 and 48 can also communicate with reservoirs 54 for an additional supply of coolant. Reservoirs 54 are at locations radially inwardly of the junctions between adjacent attachment pieces. Passages (not shown) from the rotor hub will be connected to reservoirs 54 to supply coolant thereto. In either case, the coolant never directly contacts the ceramic blades, their roots or their shanks.

I claim:

1. In a gas turbine rotor: a rotor disk having a number of circumferentially spaced, outer peripheral grooves, an attachment piece for each groove of the rotor disk, respectively, the attachment pieces having respective roots received within corresponding grooves of said rotor disk; a plurality of ceramic rotor blades, each blade having a root; and means on said attachment pieces at the radially outer margins thereof for forming root-receiving grooves, the roots of said blades being received within respective grooves of said attachment pieces, said attachment pieces having structure isolating the rotor disk from gases impinging on said blades, said rotor disk and said attachment pieces having fluid passages therein forming parts of a closed path to permit the circulation of a coolant through the attachment pieces.

2. In a gas turbine as set forth in claim 1, wherein each blade has a blade portion and a shank connecting the blade portion with its root, a first set of blades having relatively long shanks and a second set of blades having relatively short shanks, there being a blade of the second set between each pair of blades of the first set.

3. A gas turbine as set forth in claim 2, wherein each pair of adjacent attachment pieces has recess means defining a groove therebetween, the shanks and roots of the blades of the second set being received within the grooves between respective attachment pieces.

4. In a gas turbine as set forth in claim 1, wherein adjacent attachment pieces are in substantial surface contact with each other to isolate the rotor disk from said gases.

5. In a gas turbine as set forth in claim 1, wherein said roots of said blades are spaced from said rotor disk.

6. In a gas turbine as set forth in claim 1, wherein at least certain of the grooves in said attachment pieces are substantially radially aligned with the grooves in said rotor disk.

7. In a gas turbine as set forth in claim 1, wherein adjacent blades have projections in abutment with each other.

8. In a gas turbine as set forth in claim 1, wherein each attachment piece has a pair of opposed flat sides, the sides of adjacent attachment pieces being in substantial abutment with each other.

* * * * *